US005759279A

United States Patent [19]

Reglat et al.

[11] Patent Number: 5,759,279

[45] Date of Patent: Jun. 2, 1998

[54] PILOT COATER

[75] Inventors: Olivier Reglat, Montreal; David Richard Elvidge; Malcolm Kenneth Smith, both of North Vancouver, all of Canada

[73] Assignee: MacMillan Bloedel Limted, Vancouver, Canada

[21] Appl. No.: 764,401

[22] Filed: Dec. 11, 1996

[51] Int. Cl.[6] ..... B05C 1/00

[52] U.S. Cl. ..... 118/681; 118/712; 118/119; 118/126; 118/203; 118/249; 118/256; 118/261

[58] Field of Search ..... 118/681, 712, 118/119, 126, 203, 243, 249, 256, 261

[56] References Cited

U.S. PATENT DOCUMENTS

| | | | |
|---|---|---|---|
| 3,707,942 | 1/1973 | Leri | 118/68.1 |
| 3,832,213 | 8/1974 | Brenner | 118/681 |
| 4,704,296 | 11/1987 | Leanna et al. | 118/261 |
| 4,737,378 | 4/1988 | Narita et al. | 118/249 |
| 5,183,691 | 2/1993 | Hassell et al. . | |

*Primary Examiner*—Laura Edwards
*Attorney, Agent, or Firm*—C. A. Rowley

[57] ABSTRACT

A pilot coater for applying a coating on a moving web sample is formed by a backup roll, a transfer roll and a coating flow metering system metering coating flow onto the transfer roll. A pneumatic actuating system holds the transfer roll in a ready position until a sensor detects a specific portion of the web is moving into a nip found between the backing roll and transfer roll and triggers movement of the transfer roll and coating metering system to move to a coating position with the transfer roll pressed onto the paper supported on the backing roll. After a preselected period of time, the transfer roll is moved from the paper to terminate the coating operation.

4 Claims, 4 Drawing Sheets

PILOT COATER

FIELD OF INVENTION

The present invention relates to a pilot coater, more particularly, the present invention relates to a pilot coater simulating one side of a size press nip coater.

BACKGROUND OF THE INVENTION

Size press coating by application of the coating to at least one transfer roll (size press roll) and applying the coating to paper in a nip formed between a transfer roll and a second transfer roll on the opposite side of the paper sheet has become a favorable way of applying coatings to paper webs.

Many of these coaters employ particular types of metering systems for metering the application of coating to the surface of the transfer roll before the transfer roll delivers the coating into the nip. One of the preferred systems incorporates a metering rod at the outlet end of a coating head. The metering rod forms a nip with the surface of the transfer roll and thus, significantly influences the amount of coating applied to the transfer roll and available for transfer to the paper.

The use of pilot coaters for testing new coating formulations for a variety of different types of coating system are known. One of the more recent patents directed to such pilot coating systems is U.S. Pat. No. 5,183,691 issued Feb. 2, 1993 to Hassell et al. and describes the modification of a device sold to the industry under the trademark Helicoater™. Helicoaters™ employ a backing roll and a coating head. The paper sample to be coated is applied to the backing roll and is tightly wound convolutely there round, i.e. through 360°. The coating head initially is positioned at one axial end of the backing roll and is moved from one end of the backing roll to the other, i.e. axially of the backing roll as the backing roll is rotated at coating speed. This applies a helical stripe of coating around the sample or on the surface of the sample secured to the backing roll.

Sensor and Simulation Products, a division of Weyerhaeuser Company offer a modified vision of the heli type coater under the trade name "Cylindrical Laboratory Coater". The heli type coaters have gained reasonable success but has been found deficient in simulating a size press coating operation.

BRIEF DESCRIPTION OF THE PRESENT INVENTION

It is an object of the present invention to provide a pilot coater for simulating a size press coating operation.

Broadly, the present invention relates to a pilot coater comprising a transfer head including a transfer roll and means for metering the application of coating onto a peripheral surface of said transfer roll, a backing roll, means for rotating said backing roll and said transfer roll about their respective rotational axes, said rotational axes being parallel axes, means for moving said transfer head relative to said backing roll between a ready position wherein peripheral surfaces of said transfer roll and backing roll are separated by a distance and a coating position wherein said peripheral surface of said transfer roll is pressed against said peripheral surface of backing roll to form a nip, means for triggering action of said means for moving to rapidly move said transfer head from said ready position to said coating position and means for disengaging said transfer roll and moving it from said coating position to a disengaged position when a selected portion of said paper sample has been coated.

The means for moving said transfer head preferably includes means for biasing said transfer head to said coating position and stop means against which said transfer head is biased by said means for biasing when said transfer head is in said ready position.

Preferably the means for biasing is a pneumatic biasing means and said means for triggering substantially simultaneously applies further air to said pneumatic biasing means and disengages said stop means to substantially instantaneously move the transfer head into said coating position.

The stop means is preferably provided by a pneumatic cylinder means resisting the movement of the transfer roll into said coating position.

Preferably the stop means also functions to move said transfer head to said disengaged position by applying pneumatic pressure to said cylinder forming said stop means and exhausting pressure in said pneumatic biasing means.

The transfer roll is normally spaced farther from said backing roll when said transfer head is in said disengaged position than when said transfer head is in said ready position.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
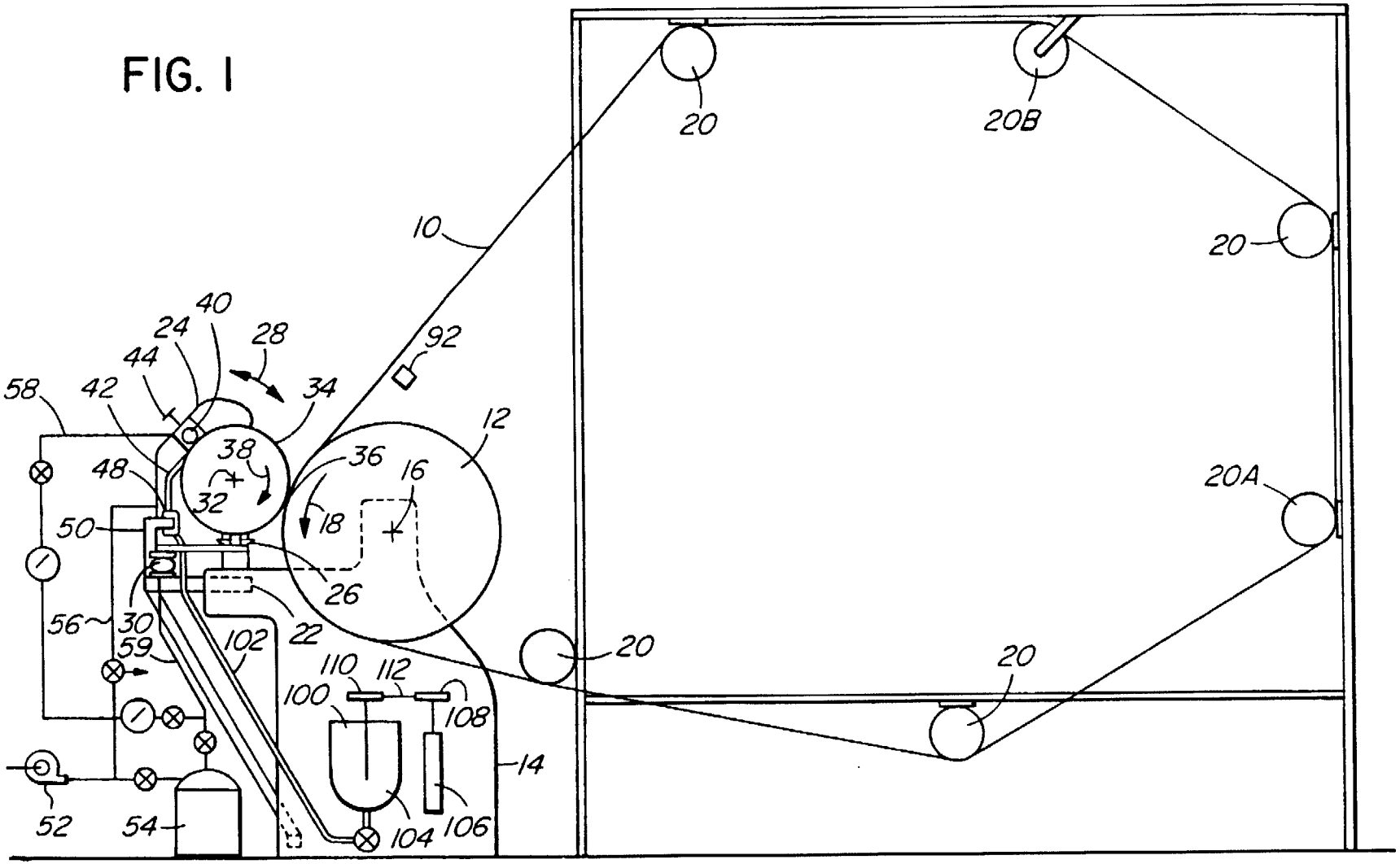
FIG. 1 is a schematic side elevation view with parts submitted illustrating the present invention.

Before describing the invention, it is important to understand the time constraint of the system. The paper to be coated travels at high velocity and the length of the sample to be coated is limited, thus, the application must be completed very quickly, generally in less than about one second from start to finish. To accomplish this, the coating head must move from ready to coating position closing the nip 36 very quickly, i.e. in less than about 10 msec. Similarly, the nip 36 must be opened rapidly.

A paper web 10 is spliced to form a loop and that is trained over a backing roll 12 of the pilot coater mounted on a frame 14 for rotation about an axis 16 and driven by a suitable drive means schematically illustrated by the arrow 18 to rotate in the direction of the arrow. The paper 10 passes from the backing roll 12 over a plurality of guide rolls 20 of which at least one is a tracking roll 20A which maintains the lateral alignment of the paper 10 and prevents it from straying laterally and a tension roll 20B which maintains the required tension on the loop of paper 10. In some cases, where a smaller sample is required, the size of the loop of paper 10 may be reduced (and the position of rolls 20 adjusted accordingly with the smallest loop being determined by the diameter of the roll 12).

Pivotably mounted on portion 22 of the frame 14 is a second frame 24 which is pivoted on pivot 26 to move as indicated by the arrow 28 from a retracted position to a ready position to a transfer or coating position as indicated and is biased for this movement via a pneumatic bellows or the like 30. Only one bellows 30 is shown. However, there is one at each end of the frame 24, i.e. at one bellows 30 at axially spaced (axial being in the direction of the axis 16). The bellows 30, as will be described, each are activated simultaneously to apply forces to the axial ends of the frame 24 and tend to move it around pivot 26.

Mounted on the frame 24 for rotation about the rotational axis 32 is a transfer roll 34. The axis 32 is parallel to the axis 16 so that the surfaces of the rolls 12 and 34 are substantially parallel in the nip 36 formed therebetween. The roll 34 is driven by means not shown but schematically represented by the arrow 38 so that the two rolls 12 and 34 are traveling in the same direction and at essentially the same surface or peripheral speed through the nip 36.

Also mounted on the frame 24 is a coating applicator schematically represented by the metering rod 40 and the coating inlet path 42. The base position of the rod 40 is adjustable via micrometer set screws 44, there being one such adjustable screw at each axial end of the metering rod 40 so that the pressure between the periphery of the rod 40 and the transfer roll 34 may be adjusted by adjusting the two screws 44 preferably to provide uniform pressure on the full length of the nip 46 formed between the roll 34 and rod 40. The adjustable biasing means also applies an added pressure to the rod 40 to press it toward the roll 36 for flow control of coating onto the roll 36 from the path 42.

Figure 2:
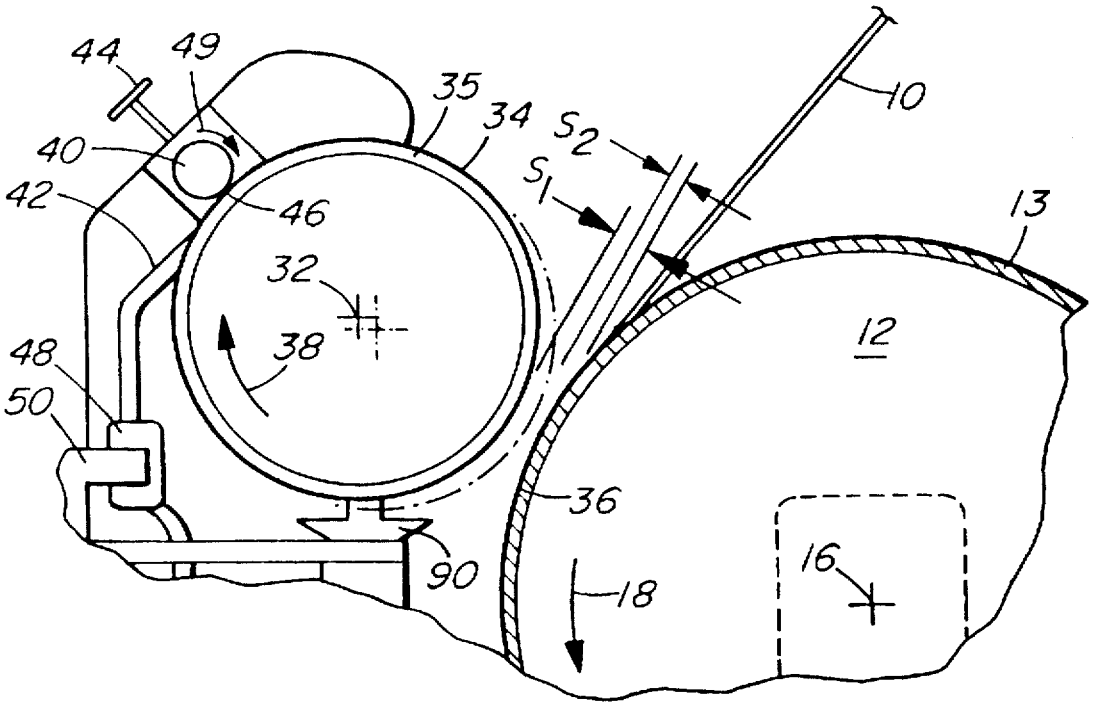
FIG. 2 is a schematic view similar to FIG. 1 but enlarged showing the nip and the nip gap in the disengaged position and in the ready position.
Figure 3:
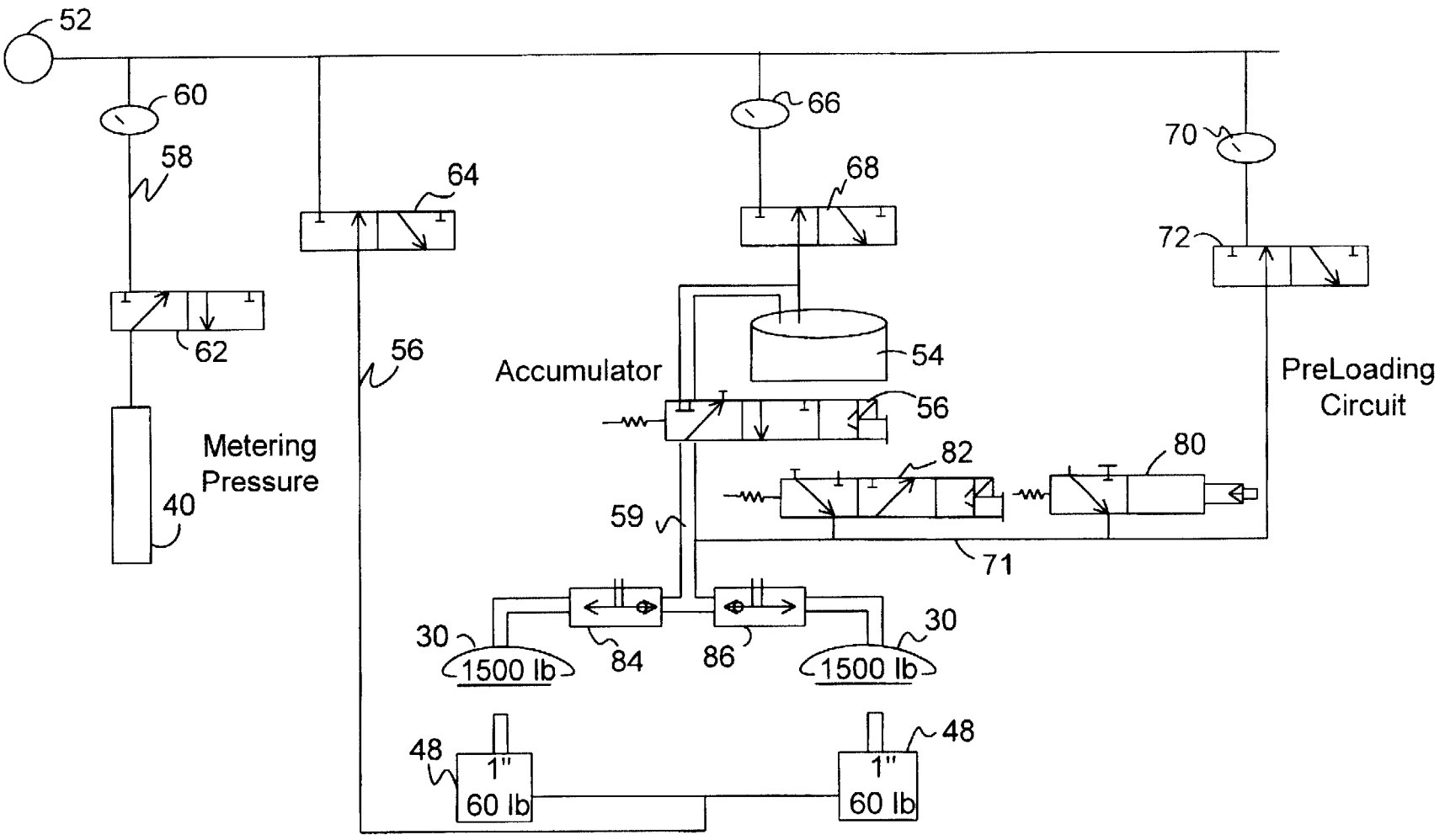
FIG. 3 is a schematic illustration of the air pressure system used with the present invention.

The rod 40 is driven to rotate preferably in the counter direction to the roll 34 by suitable drive means not shown but schematically represented by the arrow 49 (see FIG. 2).

While the applicator has been represented by a metering rod, other suitable metering system may be used.

The roll 12 is provided with a suitable cover 13 that is generally made of neoprene rubber of a selected hardness. The roll 34 is provided with a similar cover 35 of the same or slightly different hardness than the cover 13.

The frame 24 is biased by gravity to pivot around axis 26 and rest against the bellows 30. The position of the frame 24 and thus the roll 34 about axis 26 is controlled by the pneumatic bellows 30 above described in combination with the end position pneumatic cylinders 48 (only one shown, however, there are preferably one at each axial end of the frame 24). These pneumatic cylinders 48 are secured to the frame 14 via a bar or the like 50.

The pneumatic system of the present invention utilizes a compressor 52 that is connected to an accumulator 54 that is isolated from the rest of the system until the air pressure from the accumulator is required as will be described hereinbelow. Also connected to the air pressure system via line 56 is the hydraulic cylinders 48 and via line 58, the pneumatic pressure applying system for the rod 40 (this generally takes the form of at least one, probably two inflatable tubes biasing the rod 40 toward the roll 34 in well known manner). The main bellows 30 are supplied with air either directly from the compressor 52 (through a suitable pressure reducer as will be described hereinbelow or on actuation with air from the accumulator 54).

As shown, the metering pressure, i.e. the pneumatic pressure applied onto the rod 40 is delivered to the rod 40 via a line 58 and is regulated by the regulator 60 to apply the desired amount of pressure. The pressure applying means for the rod 40 is either connected to the pressure source or disconnected therefrom via the valve 62.

The positioning pneumatic cylinders 48 have a cross-section area significantly less than the corresponding air bags or bellows 30 for reasons that will be evident as the discussion proceeds.

Air pressure is applied to the cylinders 48 and vented therefrom under control of the valve 64. If desired, the valve 64 could also be made with a third position wherein the air neither enters or exhausts from the cylinders 48.

Air flow to the accumulator 54 passes via the regulator 66 and under the control of valve 68 to accumulate a significant amount of air at the desired pressure within the accumulator 54. At a selected time, the valve 56 is actuated to rapidly deliver the air from the accumulator 54 to the bellows or bags 30 via the line 59.

The air bags 30 are also fed via line 71 with air at a lower pressure as regulated by the regulator 70 and controlled by the valve 72 to apply a preloading pressure selected as desired based on the setting of the regulator 70.

The valves 80 and 82 connected to line 71 are in effect opposites, the valve 80 is in venting position when the power to the system is off while the valve 82 is closed when not energized. The valve 80's primary function is to vent the system, if, for example, there is an emergency stop and the power is cut off from all the valves. The valve 82 is activated at the end of the test and initiates retraction of the roll 34 and opening of the nip 34. The valves 84 and 86 are quick exhaust valves that rapidly release the pressure in the bellows 30 when the pressure on the bellows 30 side of the valves 84 and 86 is greater than the pressure in line 59 by a small margin which is initiated by opening valve 82.

In operation, the system when the rolls 34 is in open or disengaged position, is in the full line position shown in FIG. 2 with the gap between the rolls 34 and 12 in the nip 36 having a spacing $S_1$. In this position, the system may be purged as indicated at 110 in FIG. 4.

Figure 4:
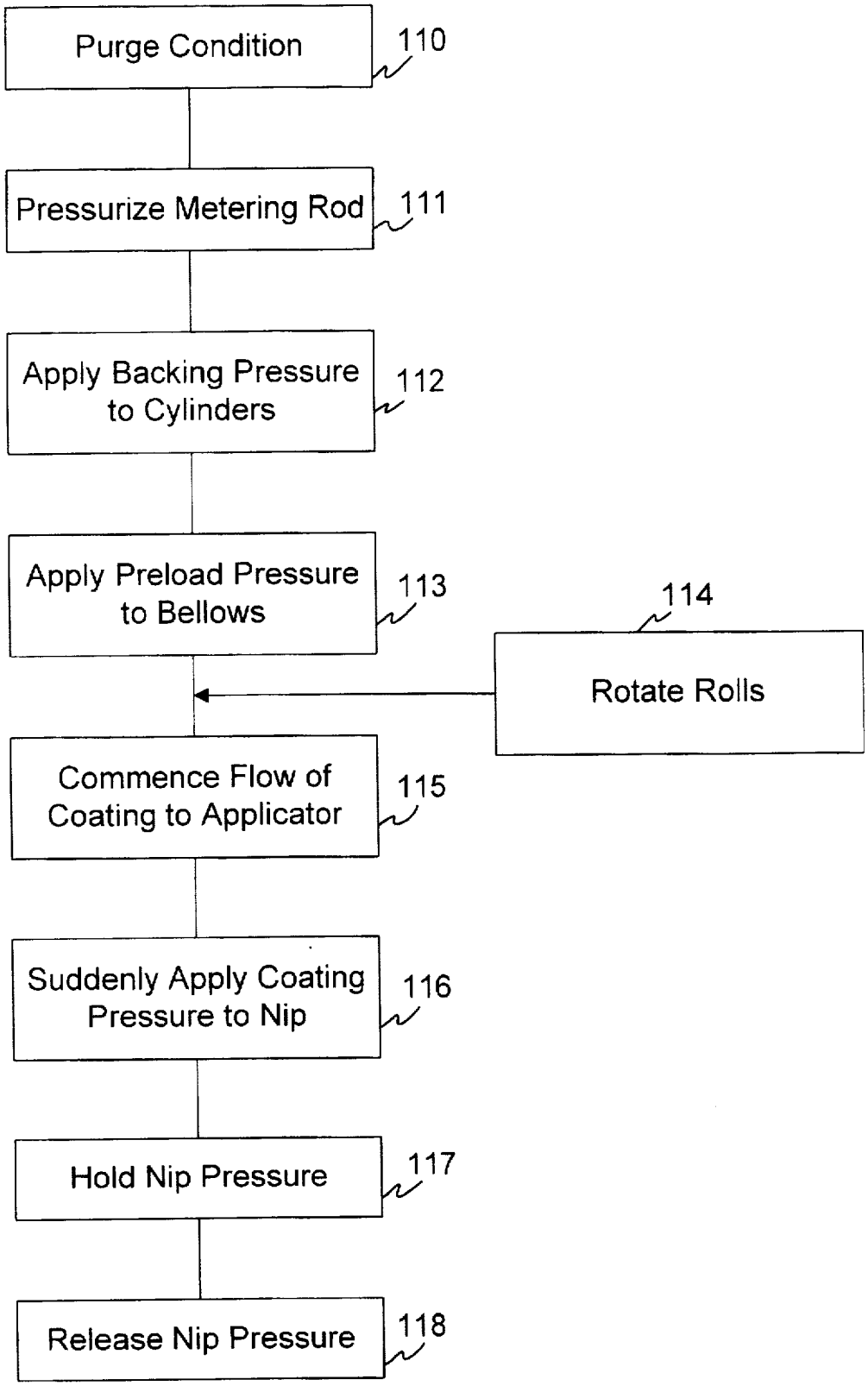
FIG. 4 is a flow diagram illustrating the operation of the system.

When the head is in the disengaged position, i.e. the solid line position in FIG. 2, the metering system is adjusted, i.e. with the illustrated system, the metering rod 40 is properly positioned and the nip 46 adjusted by the adjusting screws 44 and the air pressure entering via line 58 is set to that desired for this particular coating operation as indicated at 111 in FIG. 4. The system is then moved to the ready position with the nip gap $S_2$ and the rods 34 and 12 rotated (step 114 in FIG. 4) and coating is then fed from the tank 100 to the coating head passage 42 for application to the rotating transfer roll 34 (step 115 in FIG. 4). Initially, the coating is established on the roll 34 and the access is collected in the tray 90 and eventually disposed of or reused if desired.

In the ready position, the cylinders 48 are inflated (step 112 in FIG. 4) and the bags 30 are inflated (step 11 3 in FIG. 4) by the preloading circuit which presses the frame 24 against the stops of the pneumatic cylinders 48 and moves the roll 34 to the dotted line ready position shown in with the gap in the nip 36 now having a dimension $S_2$. The cross-sectioned area of the cylinders 48 is significantly less than bellows 30, however, the total force generated by the bellows is lower than the total force generated by the cylinders 48 when in the ready position of roll 34.

In this position, coating is applied from a suitable source 100 via tubing 102 to coating head passage 42. The coating within the coater source 100 is stirred via stirrer 104 driven by a motor 106 through pulleys 108 and 110 and a connecting belt 112.

In the ready position, the rolls 34 and 12 are being driven at their required nip speed with paper 10 passing therethrough. Similarly, the rod 40 is driven at its required speed and the coating is being applied to the transfer roll 34 in readiness for the coating operation. When the sensor 92 senses a suitable mark on the paper web 10, it triggers the valve 56 to apply fill pressure from the accumulator 54 to the air bags 30 (step 116 in FIG. 4).

It is important that increasing the pressure in bags or bellows 30 move the roll 34 very quickly (less than about 10 msec) into coating position closing the nip 36 (step 116 in FIG. 4) and hold the nip in this closed position by the pressure with the bags or bellows 30 (step 117 in FIG. 4) until it is relieved by the valve 82 (step 118 in FIG. 4).

When the trial is completed, defined by a preselected period of time based on the speed of the paper through the nip, the air bags 30 are exhausted to move the roll 34 from its nip or coating position shown in FIG. 1 to its open or disengaged position, i.e. solid line position shown in FIG. 2 (step 118 in FIG. 4).

It is possible at the same time as the bellows 30 are fully inflated to move the valve 64 to an exhausting position so that there is no pressure in the positioning cylinders 48 to resist movement of the coating head and roll 34. However, if the valve 64 is opened to vent the cylinders 48 lose their value for damping vibration and it is therefore preferred to maintain the valve 64 closed or connected to the source of air pressure to form the cylinder 48 into resilient spring like element.

Having described the invention, modifications will be evident to those skilled in the art without departing from the scope of the invention as defined in the appended claims.

We claim:

1. A pilot coater for applying a coating to a sample comprising a transfer head including a transfer roll and means for metering the application of coating onto a peripheral surface of said transfer roll, a backing roll, drive means for rotating said backing roll and said transfer roll about their respective rotational axes, said rotational aces being parallel axes, means for relatively moving said transfer head to said backing roll between a ready position wherein peripheral surfaces of said transfer roll and backing roll are separated by a first distance and a coating position wherein said peripheral surface of said transfer roll is pressed toward said peripheral surface of backing roll to form a nip therebetween, means for directing the sample to be coated through said nip, means, means for biasing said transfer head against said stop means when said transfer head is positioned said in ready position, means for triggering action of said means for moving to trigger action of said means for moving to move said transfer head from said ready position to said coating position and disengagement activating means to cause said means for moving to disengage said transfer roll from said coating position to a disengaged position wherein said transfer roll and said backing roll are spaced apart by a third second distance when a selected portion of said sample has been coated, said drive means connected to drive said transfer and said backing rolls in said ready, coating and disengaged positions.

2. A pilot coater as defined in claim 1 wherein said means for biasing is a pneumatic biasing means and wherein said means for triggering substantially simultaneously applies further air to said pneumatic biasing means and disengages said stop means to substantially instantaneously move the transfer head into said coating position.

3. A pilot coater as defined in claim 2 wherein said stop means comprises a pneumatic cylinder means resisting the movement of the transfer roll into said coating position.

4. A pilot coater as defined in claim 3 wherein said stop means is extendible to move said transfer head to said disengaged position by means for applying pneumatic pressure to said cylinder forming said stop means and reducing pressure in said said pneumatic biasing means.

* * * * *